US005567923A

United States Patent [19]

Perret

[11] Patent Number: 5,567,923

[45] Date of Patent: Oct. 22, 1996

[54] PUFFER CIRCUIT-BREAKER HAVING A PNEUMATICALLY-LOCKED SEMI-MOVING PISTON

[75] Inventor: Michel Perret, Bourgoin-Jallieu, France

[73] Assignee: GEC Alsthom T&D SA, Paris, France

[21] Appl. No.: 371,394

[22] Filed: Jan. 11, 1995

[30] Foreign Application Priority Data

Jan. 25, 1994 [FR] France ..... 94 00762

[51] Int. Cl.[6] ..... H01H 33/91

[52] U.S. Cl. ..... 218/60; 218/78

[58] Field of Search ..... 218/43, 51–53, 218/57, 59–64, 66, 68, 72, 78, 84, 86, 88, 154

[56] References Cited

U.S. PATENT DOCUMENTS 3,987,262 10/1976 Rostron ..... 200/148 A
4,103,131 7/1978 Graf et al. ..... 200/148 A

FOREIGN PATENT DOCUMENTS

0126929A3 12/1984 European Pat. Off. ..... H01H 33/91
0359224A1 3/1990 European Pat. Off. ..... H01H 33/91
3930548A1 3/1991 Germany ..... H01H 33/91
471456 5/1969 Switzerland ..... H01H 33/91

*Primary Examiner*—Brian W. Brown
*Assistant Examiner*—Michael A. Friedhofer
*Attorney, Agent, or Firm*—Sughrue, Mion, Zinn, Macpeak & Seas

[57] ABSTRACT

The present invention relates to a puffer-type circuit-breaker including two arcing contacts that cooperate with each other, at least one of which is part of a moving contact assembly constituted by a first tube and a second tube that is coaxial with the first tube so as to define a blast chamber on one side of a first annular wall interconnecting the first tube and the second tube, and a compression chamber on the other side of said annular wall, which compression chamber is closed by a semi-moving piston. A first mechanical mechanism is provided for holding the piston stationary during a first portion of the displacement of the moving contact assembly from the closed position to the open position, a second mechanical mechanism provided for axially displacing the piston with the moving contact assembly during a second portion of the same displacement of the moving contact assembly, and a pneumatic device is provided for co-operating with the first mechanical mechanism in holding the piston stationary during the first portion of displacement.

6 Claims, 3 Drawing Sheets

PUFFER CIRCUIT-BREAKER HAVING A PNEUMATICALLY-LOCKED SEMI-MOVING PISTON

The present invention relates to a puffer circuit-breaker having a pneumatically-locked semi-moving piston.

BACKGROUND OF THE INVENTION

Document EP-0475270 discloses a puffer-type circuit-breaker including a casing filled with a dielectric gas under pressure, and two arcing contacts that co-operate with each other, at least one of which is part of a moving contact assembly that is secured to a drive member, and that is capable of being displaced axially inside the casing between a closed position and an open position, the moving contact assembly being constituted by a first tube and a second tube that is coaxial with the first tube so as to define a blast chamber on one side of a first annular wall interconnecting the first tube and the second tube, and a compression chamber on the other side of said annular wall, which compression chamber communicates with the blast chamber and is closed by a semi-moving piston.

During opening, the gas in the compression chamber is compressed because the distance between the piston and the annular wall separating the compression chamber from the blast chamber decreases. In that known circuit-breaker, the dielectric gas is compressed during the entire displacement of the moving contact assembly from the closed position to the open position. A certain quantity of energy is required to displace the moving contact assembly. The required quantity of energy is particularly large since the gas in the compression chamber is compressed during the entire travel of the moving contact assembly.

OBJECTS AND SUMMARY OF THE INVENTION

An object of the invention is to reduce the energy consumption of the circuit-breaker during opening.

To this end the invention provides first mechanical means for holding the piston stationary during a first portion of the displacement of the moving contact assembly from the closed position to the open position, second mechanical means for axially displacing the piston with the moving contact assembly during a second portion of the same displacement of the moving contact assembly, and pneumatic means co-operating with the first mechanical means.

When low currents are to be interrupted, the arc that is produced between the arcing contacts during opening is extinguished by means of compressing the gas in the compression chamber. However, the arc is extinguished by a flow of gas from the compression chamber before the end of the displacement of the moving contact assembly. Therefore, it is not necessary to compress the gas in the compression chamber during the entire displacement of the moving contact assembly. Once the piston starts moving with the moving contact assembly, the quantity of energy required to drive the moving contact assembly is very small because the gas is no longer compressed.

Furthermore, pneumatic means is provided so as to co-operate with the first mechanical means which can then be lighter in weight and require less force. This is important because the forces from the mechanical means are transmitted to the moving parts of the apparatus and are, in general, taken up by the drive member, in general a connection rod, and by levers that co-operate therewith.

In a first preferred embodiment, the second mechanical means for axially displacing the piston comprises a drive member which is secured to the moving contact assembly and which drives an abutment element coupled to the piston during the second portion of the displacement of the moving contact assembly, the abutment element being disposed in the path of the drive member.

The first mechanical means for holding the piston stationary comprises a spring disposed between the fixed element and an end wall of the piston, and a fixed retaining member co-operating with an abutment wall of the piston.

The pneumatic means is a means for creating suction in the space between the fixed retaining member and the abutment wall, which space is sealed in a gastight manner.

Preferably, the pneumatic means is constituted by an annular element which is provided with at least one orifice and which is disposed between the end wall of the piston and the abutment wall of the piston, which abutment wall is itself provided with at least one orifice, the annular element being urged against the abutment wall by at least one compression spring disposed between the annular element and the end wall, thereby closing the orifice in the abutment wall in a gastight manner.

The abutment element connected to the piston is said annular element, the compression spring of the pneumatic means being compressed when the annular element is driven by the drive member.

The pneumatic means, which operates by suction during the first portion of the displacement of the moving assembly from the closed position to the open position, co-operates in holding the piston stationary, thereby enabling a very weak spring to be used. In this way, the force transmitted via the spring is also weaker, and it is not necessary to reinforce and make heavier the moving assembly with its drive rod.

BRIEF DESCRIPTION OF THE DRAWINGS

The invention is described below in more detail with reference to the accompanying drawings which merely show a preferred embodiment of the invention.

The figures of the drawings are longitudinal section views of a circuit-breaker of the invention, and more precisely.

DETAILED DESCRIPTION OF THE INVENTION

Figure 1:
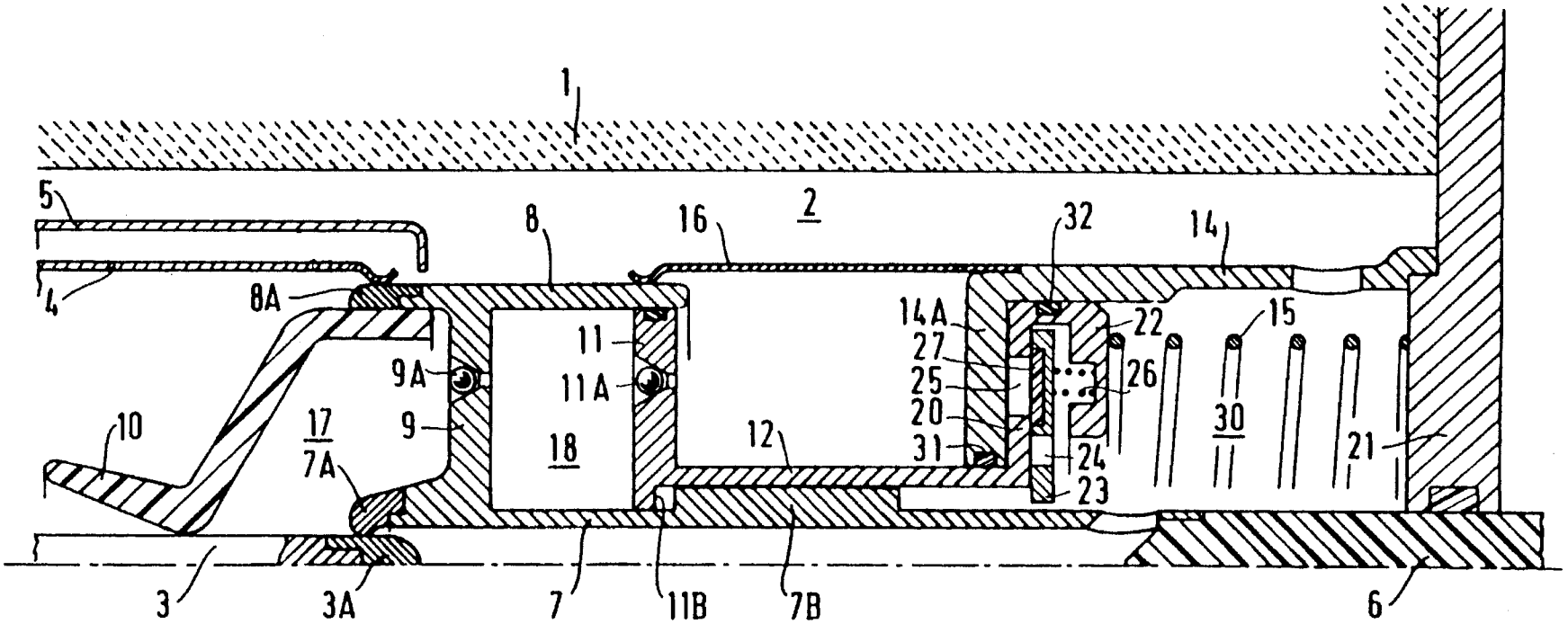
FIG. 1 is a view in the closed position.
Figure 2:
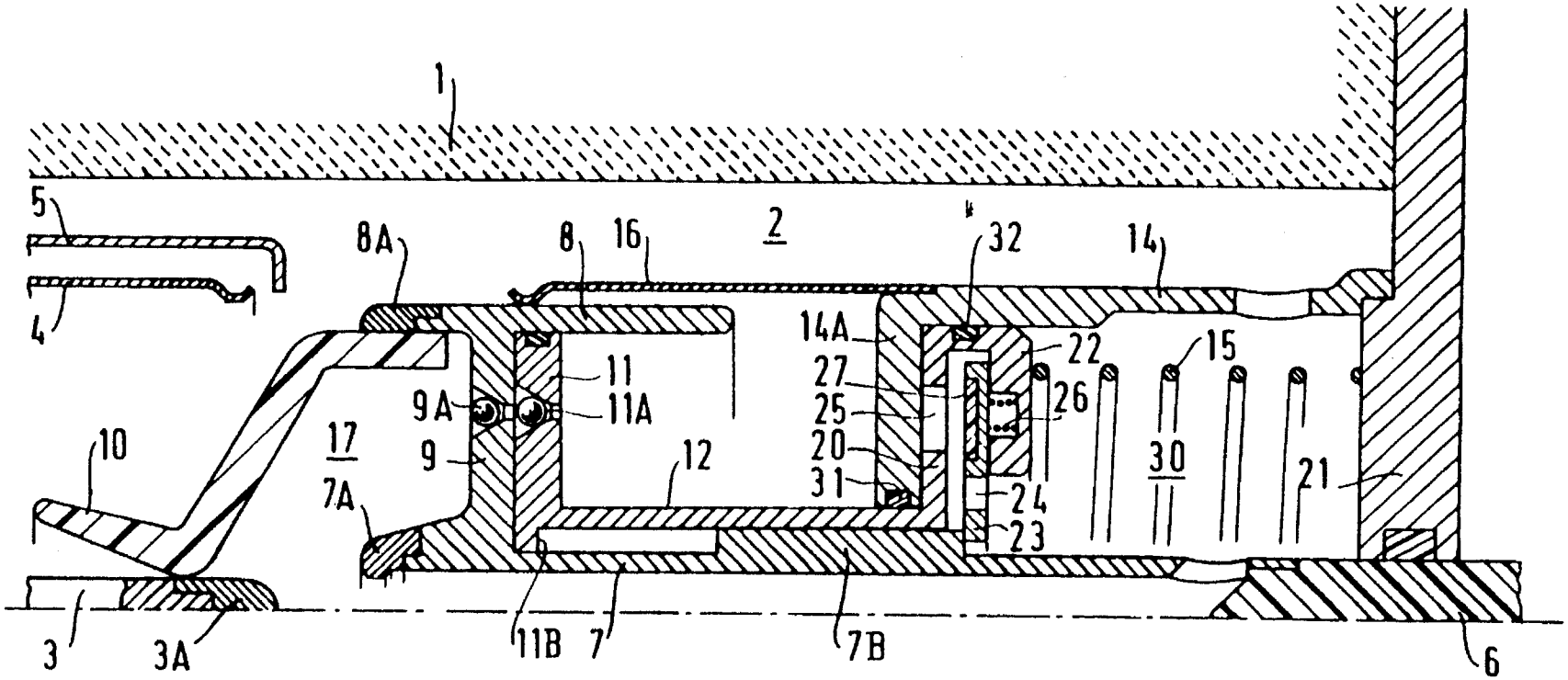
FIG. 2 is a view in the end-of-compression position.
Figure 3:
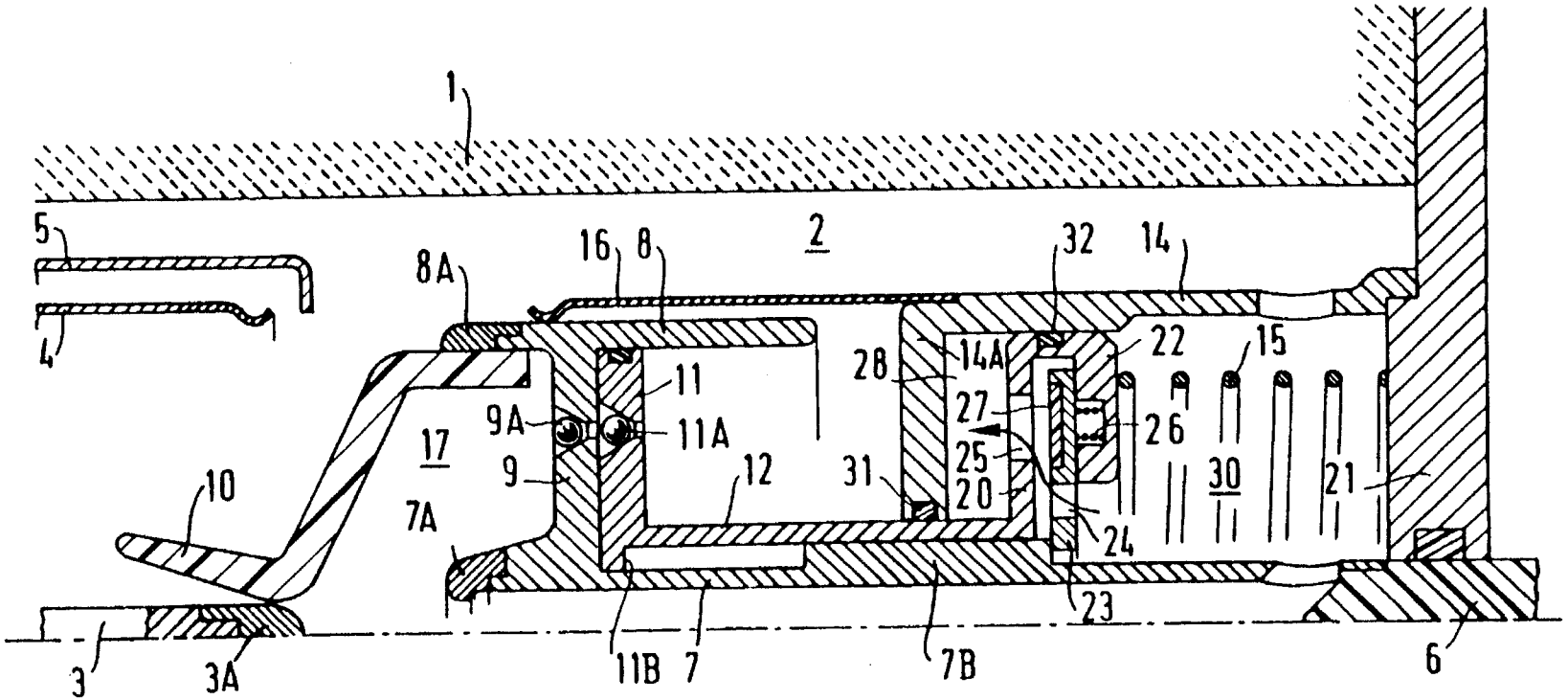
FIG. 3 is a view in the open position.

A single interrupting chamber is described below, but it is to be understood that a high-voltage circuit-breaker may include a plurality of such interrupting chambers for each phase. In FIGS. 1 to 3, the same references designate identical elements.

In the figures, reference 1 designates a casing that is preferably an insulating casing, e.g. made of porcelain, filled with a gas having good dielectric properties, e.g. sulfur hexafluoride, under a pressure of a few bars.

The circuit-breaker includes a fixed assembly and a moving contact assembly.

The fixed assembly includes an arcing contact 3 constituted by a metal tube whose end 3A is made of a material that is resistant to arcing effects, e.g. an alloy based on tungsten. The fixed assembly further includes a fixed permanent contact 4 constituted by fingers protected by an anti-corona cap 5. The arcing contact and the fixed permanent contact are connected to a first terminal (not shown).

The moving contact assembly includes a drive part 6 passing through the chamber in gastight manner and connected to a mechanism that is not shown. Part 6 is connected to a metal assembly comprising two coaxial tubes 7 and 8, tube 8 having a larger diameter than tube 7. The two tubes 7 and 8 are interconnected via a metal annular wall 9. The tubes and the annular wall are preferably machined in one piece.

Tube 7 constitutes the moving arcing contact. Its end 7A co-operates with contact 3, 3A and is made of a material that is resistant to arcing effects. Tube 8 has an end 8A carrying a blast nozzle 10 made of an insulating material. The tubular portion 8A constitutes the permanent moving contact of the circuit-breaker and, when the circuit-breaker is the engaged position (closed position) said tubular portion co-operates with the fingers 4 as shown in FIG. 1.

The end 8A of tube 8, the blast nozzle 10, tube 7 and the annular wall 9 define a blast chamber 17. The annular wall 9, the tubes 7 and 8, and a piston 11 define a compression chamber 18 separated from the blast chamber 17 by the annular wall 9. The piston is slidably mounted to slide axially between the tubes 7 and 8 in a gastight manner. The piston 11 is connected to a tube 12 that is coaxial with tubes 7 and 8. The end of tube 12 is connected to an annular wall 20 forming an abutment wall. The abutment wall 20 co-operates with an annular wall 14A connected to a fixed tube 14 that is coaxial with tube 12, annular wall 14A forming an end-of-travel abutment member for the tube 12 during closing. The tube 14 is connected electrically to a second terminal (not shown) via a fixed element 21 which is also annular. The tube 14 also supports a permanent contact formed of fingers 16 in electrical contact with tube 8.

One or more drive members 7B secured to tube 7 and extending radially relative thereto towards tube 8 are engaged between tube 7 and tube 12.

One or more springs 15 are disposed between the fixed element 21 and an end wall 22 of the piston 11.

The piston 11 is provided with a non-return valve 11A enabling gas to flow from inside the chamber defined by the casing 1 to the compression chamber 18. Annular wall 9 is provided with a non-return valve 9A enabling gas to flow from the compression chamber 18 to the blast chamber 17.

The first mechanical means for holding the piston 11 stationary during a first portion of the displacement of the moving contact assembly from the closed position to the open position therefore comprises the spring 15 that is disposed between the fixed element 21 and the end wall 22 of the piston 11, and the fixed retaining member 14A that co-operates with the abutment wall 20 of the piston 11.

The second mechanical means for axially displacing the piston 11 with the moving contact assembly during a second portion of the same displacement of the moving contact assembly comprises the drive member 7B which is secured to the moving contact assembly and which drives an abutment element 23 coupled to the piston 11 during the second portion of the displacement of the moving contact assembly, the abutment element being disposed in the path of the drive member. The abutment element 23 connected to the piston 11 is an annular element which is described in more detail below.

Pneumatic means co-operates with the mechanical means. The pneumatic means is constituted by the annular element 23 which is provided with at least one orifice 24 and which is disposed between the end wall 22 of the piston 11 and the abutment wall 20 of the piston 11, which abutment wall is itself provided with at least one orifice. The annular element 23 is urged against the abutment wall 20 by at least one compression spring 26 disposed between the annular element 23 and the end wall 22, and the annular element closes the orifice 25 in the abutment wall in a gastight manner by means of a washer 27 that is preferably made of rubber and that is inserted in the annular element 23. The compression spring 26 of the pneumatic means is compressed when the annular element 23 is driven by the drive member 7B. Slidably-mounted sealing gaskets 31, 32 are provided to make the suction chamber 28 (shown in FIG. 3) gastight.

The circuit-breaker operates as follows.

In FIG. 1, the circuit-breaker is in the closed position. The spring 15 pushes the semi-moving piston 11 via its end wall 22, its abutment wall 20 being pressed against the fixed abutment annular member 14A. The compression chamber 18 is then at its maximum volume. The compression spring 26 pushes the annular element 23 against the abutment wall 20, thereby closing its orifice 25. Since the space filled with gas between the annular element 23 and the fixed abutment member 14A is very small, the pneumatic means then acts by suction as means for holding the piston 11 against the abutment member 14A, in addition to the action of the spring 15 which can therefore be chosen to be small.

During the first portion of the opening displacement, the drive member 6 is displaced towards the right of FIG. 1, thereby displacing the first tube 7 and the second tube 8. The volume of the compression chamber 18 is reduced, since the piston remains stationary, and the arc is blasted by the gas contained in chamber 18 passing through valve 9A. The drive member 7B is displaced freely along tube 12. The first portion of the displacement takes the circuit-breaker to the position shown in FIG. 2.

In the position shown in FIG. 2, the volume of the compression chamber 18 is substantially zero, and the drive member 7B abuts against the annular element 23. Advantageously, the dimensions of the compression chamber 18, of tube 12 and of tube 14, and the positioning of the drive member 7B are chosen so that the volume of the compression chamber is substantially zero at that time. Optionally the compression chamber may be given a "dead" volume that is not zero by choosing other dimensions.

When it abuts against the annular element 23, the drive member 7B pushes the annular element against the force of the compression spring 26, thereby releasing orifices 24 and 25. In this way, the gas can penetrate into the suction chamber 28, thereby eliminating the retaining force due to the suction. The second portion of the displacement of the moving contact assembly begins, and the piston 11 is displaced with the moving assembly. During the second portion of the displacement of the moving contact assembly, the compression of the gas in the compression chamber 18 is interrupted and the amount of energy required to actuate the drive tube 6 is therefore small. In this way, the open position shown in FIG. 3 is reached.

To re-close the circuit-breaker, the displacements take place in exactly the opposite direction, with the gas passing back from the suction chamber 28 to the space 30 and filling the compression chamber 18 by passing through valve 11A. In addition, the drive member 7B pushes the front end of the piston 11 over a relatively short distance via the abutment portion 11B, thereby pressing the abutment wall 20 against the fixed retaining member 14A and putting the suction pneumatic means back into action.

I claim:

1. A puffer-type circuit-breaker comprising:

a casing filled with a dielectric gas under pressure, and two arcing contacts that co-operate with each other, at least one of which is part of a moving contact assembly that is secured to a drive member, and that is operative for displacement axially inside the casing between a closed position and an open position, the moving contact assembly including a first tube and a second tube that is coaxial with the first tube, the first tube and the second tube being interconnected by a first annular wall so as to define a blast chamber on one side of the first annular wall, a compression chamber on the other side of said annular wall and which communicates with the blast chamber, and a semi-moving piston having one end which closes the compression chamber, wherein the circuit-breaker further comprises first mechanical means for holding the piston stationary during a first portion of the displacement of the moving contact assembly from the closed position to the open position, second mechanical means for axially displacing the piston with the moving contact assembly during a second portion of the displacement of the moving contact assembly, and pneumatic means for co-operating with the first mechanical means in holding the piston stationary during the first portion of displacement.

2. The circuit-breaker according to claim 1, wherein the second mechanical means, for axially displacing the piston, comprises a drive member which is secured to the moving contact assembly and which drives an abutment element coupled to the piston during the second portion of the displacement of the moving contact assembly, the abutment element being disposed in the path of the drive member.

3. The circuit-breaker according to claim 1, wherein the casing includes a fixed element having a fixed retaining member, and wherein the piston has an opposite end including an end wall and a spaced apart abutment wall, the first mechanical means, for holding the piston stationary comprising a spring disposed between the fixed element and the end wall of the piston, and the fixed retaining member co-operating with the abutment wall of the piston.

4. The circuit-breaker according to claim 3, wherein the pneumatic means creates a suction in a space between the fixed retaining member and the abutment wall of the piston, said space being sealed in a gastight manner.

5. The circuit-breaker according to claim 4, wherein the pneumatic means comprises an annular element which is provided with at least one orifice and which is disposed between the end wall of the piston and the abutment wall of the piston, said abutment wall of the piston being provided with at least one orifice, the annular element being urged against the abutment wall of the piston by at least one compression spring disposed between the annular element and the end wall of the piston, thereby closing the orifice in the abutment wall in a gastight manner.

6. The circuit-breaker according to claim 3, wherein the abutment element comprises an annular element, and wherein the pneumatic means comprises the annular element which is provided with at least one orifice and which is disposed between the end wall of the piston and the abutment wall of the piston, said abutment wall of the piston being provided with at least one orifice; and at least one compression spring disposed between the annular element and the end wall, the annular element being urged against the abutment wall of the piston by said at least one compression spring, thereby closing the orifice in the abutment wall in a gastight manner.

* * * * *